US008275304B2

(12) United States Patent
Takenaka

(10) Patent No.: US 8,275,304 B2
(45) Date of Patent: Sep. 25, 2012

(54) IMAGE FORMING APPARATUS AND SHEET TRANSPORT CONTROLLING METHOD USED THEREIN

(75) Inventor: Ryo Takenaka, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 461 days.

(21) Appl. No.: 12/314,066

(22) Filed: Dec. 3, 2008

(65) Prior Publication Data

US 2009/0148210 A1 Jun. 11, 2009

(30) Foreign Application Priority Data

Dec. 10, 2007 (JP) ..... 2007-318957

(51) Int. Cl.
*G03G 15/00* (2006.01)

(52) U.S. Cl. ..... 399/405; 399/407; 399/401

(58) Field of Classification Search ..... 399/401, 399/405, 407, 410, 381; 271/301
See application file for complete search history.

(56) References Cited

U.S. PATENT DOCUMENTS

| | | | | |
|---|---|---|---|---|
| 4,780,745 | A | 10/1988 | Kodama | |
| 6,134,418 | A | 10/2000 | Kato et al. | |
| 6,542,715 | B2 * | 4/2003 | Miyamoto et al. | 399/405 |
| 6,553,193 | B1 * | 4/2003 | Takara | 399/82 |
| 6,671,472 | B2 * | 12/2003 | Shimizu et al. | 399/82 |
| 7,050,752 | B2 * | 5/2006 | Sato et al. | 399/405 |
| RE39,168 | E * | 7/2006 | Hirota et al. | 399/407 |
| 7,417,758 | B2 * | 8/2008 | Miyake et al. | 358/1.15 |
| 7,822,379 | B2 * | 10/2010 | Nakamura et al. | 399/405 |
| 2005/0232672 | A1 | 10/2005 | Nakamura et al. | |
| 2006/0051147 | A1 | 3/2006 | Sato et al. | |

FOREIGN PATENT DOCUMENTS

| | | | |
|---|---|---|---|
| JP | 05147771 | A * | 6/1993 |
| JP | 2000-086076 | | 3/2000 |
| JP | 2001-134033 | | 5/2001 |
| JP | 2002-308520 | | 10/2002 |
| JP | 3425007 | | 5/2003 |
| JP | 3679701 | | 5/2005 |
| JP | 3753891 | | 12/2005 |

OTHER PUBLICATIONS

European Search Report dated Mar. 23, 2009 for corresponding European Application No. 08253822.4.
Abstract of JP 08-340414 published Dec. 24, 1996.
Abstract of JP 2000-327170 published Nov. 28, 2000.
Abstract of JP 2002-128355 published May 9, 2002.
Office Action dated Dec. 7, 2011 for corresponding Chinese Patent Application No. 200810177117.1.

* cited by examiner

*Primary Examiner* — Judy Nguyen
*Assistant Examiner* — Justin Olamit
(74) *Attorney, Agent, or Firm* — Harness, Dickey & Pierce, P.L.C.

(57) ABSTRACT

An image forming apparatus includes an image reading unit configured to read image information of an original document, an image forming unit configured to form an image on a sheet according to the image information, a sheet discharge space located between the image reading unit and the image forming unit, into which the sheet is discharged after passing through the image forming unit, a first sheet discharge port disposed facing the sheet discharge space, a second sheet discharge port located beneath the first sheet discharge port, and a sheet handling unit detachably mountable in the sheet discharge space, configured to connect to the first sheet discharge port and block the second sheet discharge port when mounted in the sheet discharge space.

8 Claims, 7 Drawing Sheets

IMAGE FORMING APPARATUS AND SHEET TRANSPORT CONTROLLING METHOD USED THEREIN

CROSS-REFERENCE TO RELATED APPLICATIONS

This patent specification claims priority from Japanese Patent Application No. 2007-318957, filed on Dec. 10, 2007 in the Japan Patent Office, the entire contents of which are hereby incorporated by reference herein.

BACKGROUND OF THE INVENTION

1. Field of the Invention

The present invention generally relates to an image forming apparatus such as a copier, a printer, a facsimile machine, a multifunction machine including at least two of those functions, etc., and sheet transport controlling method used therein, and more particularly, to an image forming apparatus including a sheet handling unit and sheet transport controlling method used therein.

2. Discussion of the Background Art

In general, an electrophotographic image forming apparatus, such as a copier, a printer, a facsimile machine, a multifunction machine including at least two of those functions, etc., includes an image reading unit that reads image information of an original document and an image forming unit that forms an image on a sheet of recording media according to the image information. The image forming unit forms an electrostatic latent image on an image carrier, develops the latent image with developer, and transfers the developed image (toner image) onto the sheet.

Some image forming apparatuses are provided with a sheet handling unit for performing post-processing, for example, aligning, sorting, stapling, and/or punching the sheets. Although the sheets can be discharged from a side of the image forming apparatus and the sheet handling unit can be attached to the side thereof, such a configuration makes the image forming apparatus bulkier.

At present, in many image forming apparatuses, a sheet discharge space is provided within an installation area of a main body thereof (hereinafter "housing-internal discharge type image forming apparatus"), for example, beneath the image reading unit, to make the image forming apparatus more compact as well as increase image formation speed.

In order to further reduce overall size of the image forming apparatus including the sheet handling unit, several approaches are known.

A known housing-internal discharge type image forming apparatus includes a compact sheet handling unit attached to a side thereof, and a relay transport member that transports a sheet between a sheet discharge space and the sheet handling unit. In this image forming apparatus, when the sheet is discharged without post-processing, the sheet is discharged to the sheet discharge space from a sheet discharge port that is different from a sheet discharge port connecting to the sheet handling unit.

In another known housing-internal discharge type image forming apparatus, a sheet handling unit is provided in a sheet discharge space in order to reduce the overall size of the image forming unit. In this image forming apparatus, the sheet handling unit can be within an installation area of a main body thereof, keeping the overall size compact.

Yet in another known housing-internal discharge type image forming apparatus, a sheet reverse path is formed using a sheet discharge space, and, in duplex printing mode, a sheet is reversed through the sheet reverse path after an image is formed on a first side thereof. In this configuration, because a sheet reverse unit to be attached to a side of the image forming apparatus is not necessary, the overall size thereof can be reduced. Further, the sheet reverse path can be provided separately from a sheet receiving part of the sheet handling unit located inside the housing of the image forming apparatus.

However, in such an image forming apparatus including the sheet handling unit mountable in the sheet discharge space located within the housing, the height of the image forming apparatus will be increased so as to attain a sufficiently large opening of the sheet discharge space to enable a user to check the sheet discharged thereinto and remove the sheet therefrom. Thus, it is difficult to balance the user's need for easy access to the sheet with the general need for compactness of the image forming apparatus.

More specifically, in the image forming apparatus including the sheet handling unit mountable in the sheet discharge space located within the housing, generally, an identical path is used to reverse the sheet after an image is formed on the first side and to discharge the sheet after an image is formed on a second side thereof, which is described in further detail with reference to FIG. 13.

FIG. 13 illustrates an example of the image forming apparatus including the sheet handling unit mountable in the sheet discharge space located within the housing.

As shown in FIG. 13, when a sheet handling unit 200Z is not mounted in a sheet discharge space 400, it is necessary to attach a discharge tray 41Z on which the sheets are stacked to the image forming apparatus. The sheet discharge tray 41Z should be located at a position lower than that of a sheet discharge port 30, and a vertical distance therebetween should be set so as to be able to stack the sheets neatly on the discharge tray 41Z when multiple sheets are discharged.

However, the location of the sheet discharge port 30 should be determined in consideration of location of a sheet receiving port 30A of the sheet handling unit 200Z that engages the sheet discharge port 30 as well. Because the location of the sheet receiving port 30A depends on the specific configuration of components of the sheet handling unit 200Z, such as a puncher, a stapler, etc., it will be higher than a preferred location of the sheet discharge port 30 with respect to the sheet discharge tray 41Z.

Therefore, the sheet discharge tray 41Z should be increased in height in accordance with the location of the sheet discharge port 30 with respect to the sheet receiving port 30A of the sheet handling unit 200Z, which reduce the sheet discharge space 400 in the vertical direction. Accordingly, visibility of the sheet discharged on the sheet discharge tray 41Z as well as accessibility thereto are degraded.

Further, in the case where the sheet reverse path (switchback reverse path) is provided separately from the sheet receiving part 30A of the sheet handling unit 200Z, because a second sheet discharge port is provided at a portion higher than that of the sheet receiving port 30A of the sheet handling unit 200Z, the sheet discharge space is relatively large in the vertical direction. Accordingly, the height of the image forming apparatus is increased, which degrades accessibility to the image reading unit provided on an upper portion thereof and increases the cost of the image forming apparatus.

SUMMARY OF THE INVENTION

In view of the foregoing, in one illustrative embodiment of the present invention, an image forming apparatus includes an image reading unit configured to read image information of an original document, an image forming unit configured to form an image on a sheet according to the image information, a sheet discharge space located between the image reading unit and the image forming unit, into which the sheet is discharged after passing through the image forming unit, a first sheet discharge port disposed facing the sheet discharge space, a second sheet discharge port located beneath the first sheet discharge port, and a sheet handling unit detachably mountable in the sheet discharge space, configured to connect to the first sheet discharge port and block the second sheet discharge port when mounted in the sheet discharge space.

In another illustrative embodiment of the present invention, a method of controlling a transport velocity of a sheet of recording media in the described above includes transporting the sheet at a velocity V1 during image formation, and transporting the sheet at a velocity V2 faster than the velocity V1 before and after a switchback operation.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
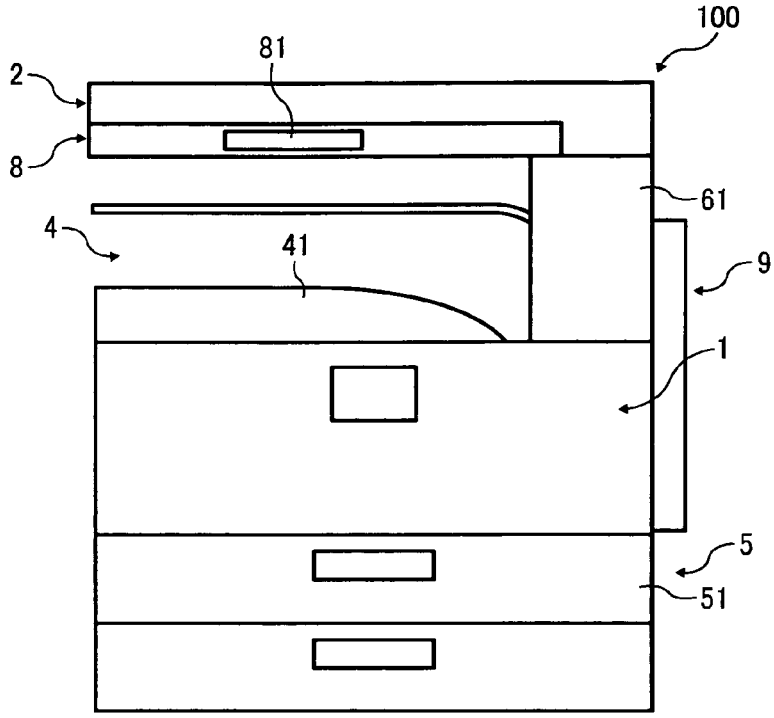
FIG. 1 is a schematic view illustrating an exterior of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
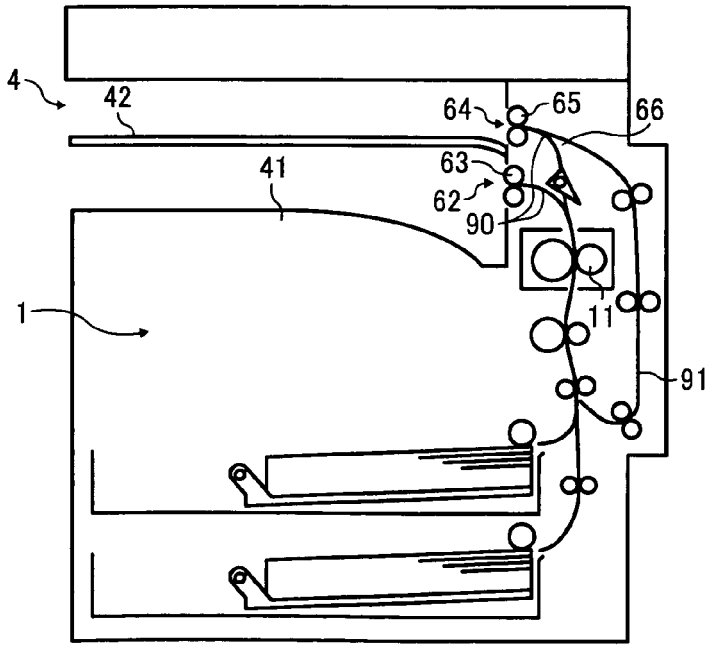
FIG. 2 is a cross-sectional view illustrating an interior of the image forming apparatus shown in FIG. 1.

Referring now to the drawings, wherein like reference numerals designate identical or corresponding parts throughout the several views thereof, and particularly to FIGS. 1 and 2, an electronographic image forming apparatus according to an illustrative embodiment of the present invention is described.

FIG. 1 is an external view illustrating an image forming apparatus according to the present embodiment, and FIG. 2 is a cross-sectional view illustrating an interior thereof.

As shown in FIG. 1, an image forming apparatus 100 includes an image reading unit 2 located in an upper portion thereof, and an image forming unit 1 located beneath the image reading unit 2, an control panel 8 located on a front side of the image reading unit 2, and a sheet feeder 5, located in a bottom portion thereof, that feeds sheets of recording media to the image forming unit 1. The recoding media includes paper, an overhead projector (OHP) film, etc. The image reading unit 2 reads image information of an original document, and the image forming unit 1 forms an image on the sheet according to the image information. The control panel 8 includes an operation display 81 that displays an operational state of the image forming apparatus 100.

The image forming apparatus 100 further includes an sheet discharge space 4, provided between the image forming unit 1 and the image reading unit 2, a sheet reverse unit 9, located on the right in FIG. 1, that reverses the sheet in a duplex print mode, a cover 61 located on the right in FIG. 1, and a removable discharge tray 41 located on a bottom portion of the sheet discharge space 4.

The image forming unit 1 further includes a laser writing unit and a known electronographic image forming engine including a photoreceptor, a charge unit, a developing unit, etc., although not shown in FIGS. 1 and 2. The laser writing unit directs laser light onto a surface of the photoreceptor, forming an electrostatic latent image thereon. The latent image is then developed with toner, and the developed image (toner image) is transferred from the photoreceptor onto the sheet either directly or via an intermediate transfer member. The image transferred onto the sheet is fixed thereon by a fixer 11 shown in FIG. 2.

Referring to FIG. 1, the sheet feeder 5 is located at an extreme upstream position in a sheet transport direction, and includes two sheet cassettes 51 in the present embodiment. The image reading unit 2 includes a contact glass located on an upper surface thereof, and a scanner unit located beneath the contact glass.

Excluding the front side, two sides of the sheet discharge space 4, which are respectively on the right in FIG. 1 and on a back surface of the paper on which FIG. 1 is drawn, are enclosed by side walls (hereinafter "right wall" and "back wall") of the image forming apparatus 100. Further, a top side and a bottom side of the sheet discharge space 4 are enclosed by the image reading unit 2 and the image forming unit 1, respectively.

The cover 61 covers a right side portion of the image forming unit 100 in FIG. 1 in which a sheet transport path 90 and transport rollers arranged along the sheet transport path 90 are provided as shown in FIG. 2. The sheet transport path 90 branches into two directions, one leading to a first discharge port 64 and the other leading to a second discharge port 62 located beneath the first discharge port 64.

The discharge tray 41 is detachably mounted on an upper surface of the image forming unit 1, that is, in the sheet discharge space 4. An upstream portion of the discharge tray 41 is located beneath the second discharge port 62, and a height thereof gradually increases downstream in a sheet discharge direction. Thus, the sheets discharged onto the discharge tray 41 can slide down into the recessed upstream portion and be aligned thereon, while simultaneously providing sufficient height for the user to pick up the sheet from the sheet discharge space 4, that is, usability of the image forming apparatus 100 can be enhanced.

After the image forming unit 1 forms an image on the sheet, the sheet is discharged onto the discharge tray 41 through the second discharge port 62. The second discharge port 62 is provided with a discharge brush configured to contact an overall surface of the sheet to remove an electrical charge given to the sheet during an electronographic image forming process from the sheet while the sheet passes through the second discharge port 62.

Referring to FIG. 2, the sheet reverse unit 9 includes a duplex transport path 91. In the duplex print mode, the sheet is again transported to the image forming unit 1 through the duplex transport path 91 after an image is formed on a first side thereof. The image forming apparatus 100 further includes a removable ancillary tray 42, a pair of first discharge rollers 65 located upstream of the first discharge port 64, and a pair of second discharge rollers 63 located upstream of the second discharge port 62.

After an image is formed on the first side thereof, the first discharge rollers 65 rotate in a normal direction, thus discharging the sheet partly through the first discharge port 64 onto the ancillary tray 42. Then, when a trailing edge portion of the sheet reaches a reverse branch member 66, the first discharge rollers 65 change rotational direction so as to forward the sheet to the duplex transport path 91, which is hereinafter referred to as a switchback operation.

A sheet handling unit according to the present embodiment is described below with reference to FIGS. 3 and 4.

Figure 3:
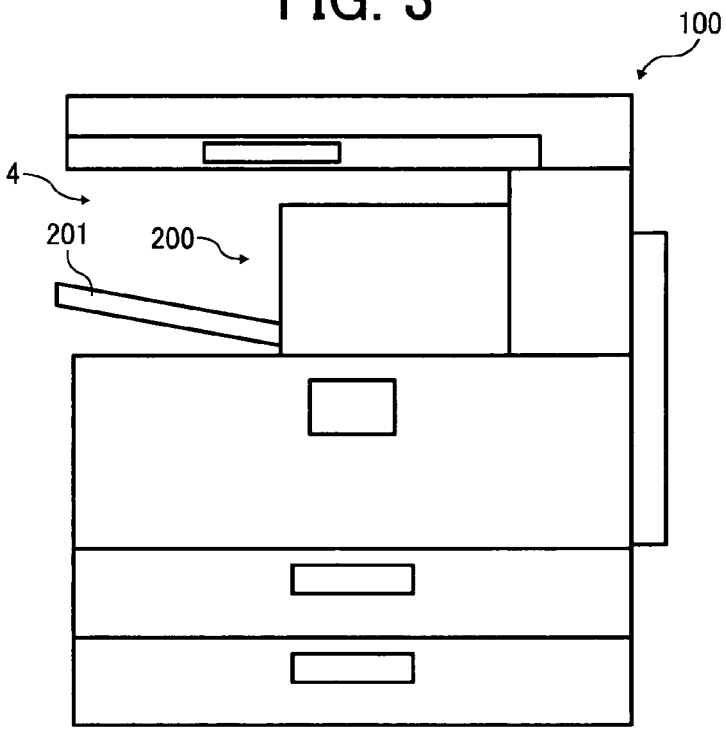
FIG. 3 is a schematic view illustrating the image forming apparatus shown in FIG. 1, in which a sheet handling unit according to the present embodiment is mounted.
Figure 4:
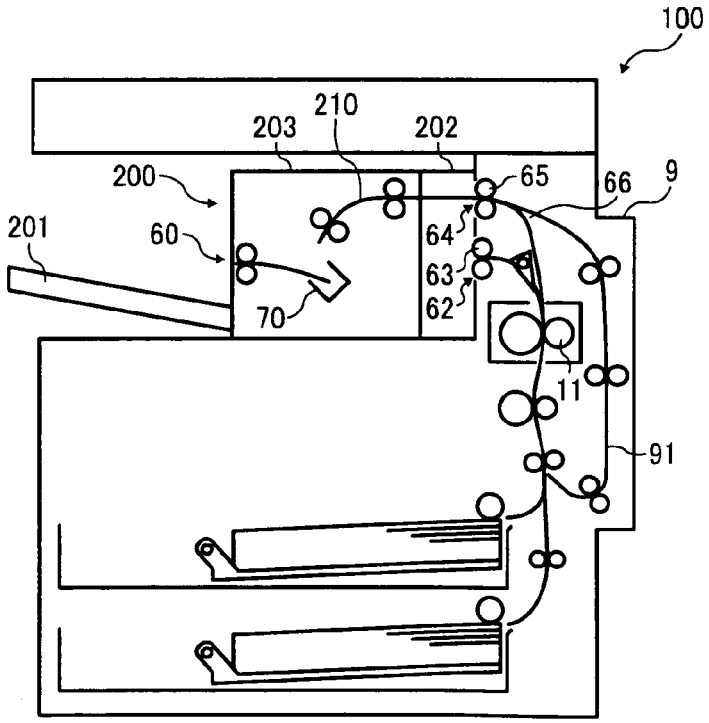
FIG. 4 is a cross-sectional view illustrating interiors of the image forming apparatus and the sheet handling unit shown in FIG. 3.

FIG. 3 illustrates a sheet handling unit 200 according to the present embodiment, mounted in the image forming apparatus 100, and FIG. 4 is a cross-sectional view illustrating interiors of the image forming apparatus 100 and the sheet handling unit 200.

The sheet handling unit 200 performs post-processing, for example, aligning, sorting, stapling, and/or punching of the sheets and then discharges the sheets onto a stack tray 201.

As shown in FIG. 4, the sheet handling unit 200 includes a discharge port 60, the stack tray 201, a punch unit 202, a stapler unit 203, and a transport path 210 along which the sheet is transported. The stack tray 201 is extendable and retractable according to sheet size. Further, a stapler 70 and a punch, not shown, are provided beneath the transport path 210.

The sheet handling unit 200 can be mounted in and removed from the sheet discharge space 4 of the image forming apparatus 100, and engages the first discharge port 64. When the sheet handling unit 200 is mounted in the image forming apparatus 100, the first discharge port 64 connects to the transport path 210, and the second discharge port 62 is blocked.

In the configuration described above, the sheet discharged from the first discharge port 64 enters the sheet handling unit 200 and travels along the transport path 210. Then, the sheet is punched in the punch unit 202 as required, and further transported along the transport path 210 to the stapler unit 203.

In the stapler unit 203, when stapling is selected, several sheets are sequentially forwarded down to the stapler 70 by a switchback unit, stapled by the stapler 70, and then discharged from the discharge port 60 onto the stack tray 201. By contrast, when stapling is not selected, the sheet is transported along the transport path 210 onto the stack tray 201 without being forwarded to the stapler 70.

In the configuration described above, a sufficient difference in height can be secured between the discharge port 60 and the stack tray 201. Further, it is not necessary to expand the sheet discharge space 4 in a vertical direction because a height of the sheet handling unit 200 can be relatively low without sacrificing performance of the sheet handling unit 200. Thus, size as well as cost of the image forming apparatus can be reduced while securing visibility of the sheet discharged onto the stack tray 201 and the accessibility of the user thereto.

Figure 5:
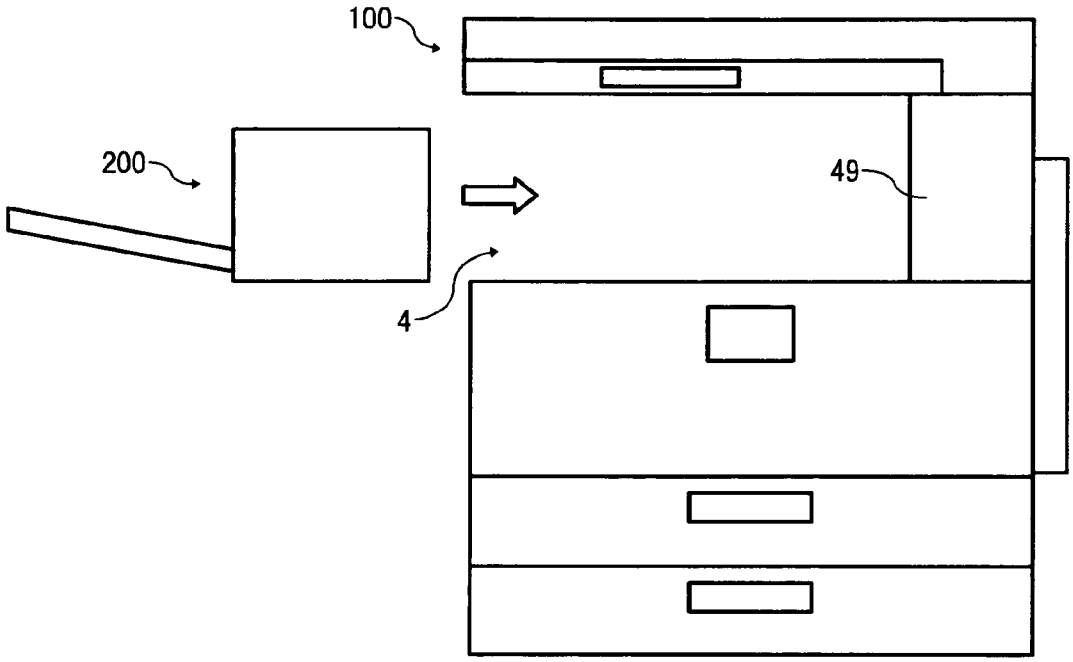
FIG. 5 illustrates installation of the sheet handling unit shown in FIG. 3 to the image forming apparatus shown in FIG. 1.

Installation of the sheet handling unit 200 to the image forming apparatus 100 is described below with reference to FIGS. 2 and 5.

First, the discharge tray 41 and the ancillary tray 42 shown in FIG. 2 are removed from the sheet discharge space 4. Then, referring to FIG. 5, the sheet handling unit 200 is mounted in the sheet discharge space 4 in a direction indicated by an arrow. Although not shown in FIG. 5, the sheet handling unit 200 includes positioning pins that respectively engage positioning holes provided on a front right column 49 and the back wall of the image forming apparatus 100. After the positioning pins are engaged with the respective positioning holes, the sheet handling unit 200 is fixed to the image forming apparatus 100 with screws. Screw holes can be provided on the back wall, for example, and the right wall of the image forming apparatus 100.

As described above, the sheet handling unit 200 is mounted in the sheet discharge space 4 of the image forming apparatus 100 toward upstream in a direction in which the sheet is discharged (hereinafter "sheet discharge direction"), that is, a direction opposite the sheet discharge direction, and removed therefrom in the sheet discharge direction. Accordingly, the sheet is not pressed by the sheet handling unit 200 when the sheet handling unit 200 is removed from the image forming apparatus 100 in the case of jamming between the image forming apparatus 100 and the sheet handling unit 200, preventing or reducing damage to the sheet.

Further, a single unit can be used for the sheet handling unit 200, and the discharge tray 41 and the ancillary tray 42 by configuring the discharge tray 41 and the ancillary tray 42 to be attached to and removed from the image forming apparatus 100 in directions identical or similar to those of the sheet handling unit 200.

Next, a copying operation performed by the image forming apparatus 100 when the sheet handling unit 200 is not mounted therein is described below with reference to FIG. 6.

Figure 6:
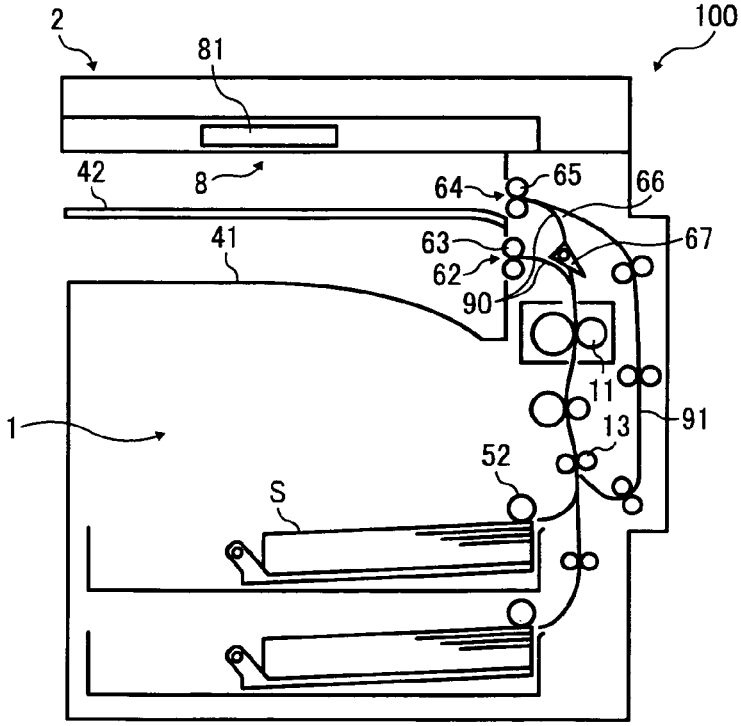
FIG. 6 is a cross-sectional view illustrating an interior of the image forming apparatus shown in FIG. 1, in which the sheet handling unit is not mounted.

Referring to FIG. 6, the image forming apparatus 100 further includes sheet feed rollers 52, a pair of registration rollers 13, a reverse branch member 66, and a switching member 67 pivotable on a support point so as to switch directions in which the sheet is transported.

First, the user sets an original document on the contact glass of the image reading unit 2, designates the number of copies, etc., on the control panel 8, and then presses a start button provided thereon. Subsequently, the image reading unit 2 starts reading image information of the original document, and then the image information is converted to digital image signals.

Then, the laser writing unit of the image forming unit 1 directs laser light onto the surface of the photoreceptor, forming an electrostatic latent image thereon. The latent image is developed and then transferred from the photoreceptor onto a sheet S that is fed by the feed roller 52. Further, the fixer 11 fixes the image (toner image) on the sheet S.

In single-side print mode, the switching member 67 guides the sheet S carrying an image on the first side thereof (hereinafter "single-side print sheet") to the second discharge rollers 63, and thus the sheet S is discharged onto the discharge tray 41.

By contrast, in the duplex print mode, the switching member 67 guides the sheet S to the first discharge rollers 65, and thus the sheet S is transported to the first discharge port 64. When a trailing edge portion of the sheet S passes the reverse branch member 66, the first discharge rollers 65 stop. Then, after a predetermined or given time period, the first discharge rollers 65 start rotating in the reverse direction so as to transport the sheet S to the duplex transport path 91 of the sheet reverse unit 9. Thus, the sheet is again transported to the image forming unit 1, an image is formed on a second side thereof, and then the sheet S carrying images on both side thereof (hereinafter "duplex print sheet") is transported to the second discharge port 62.

It is to be noted that, although the reverse branch member 66 guides the sheet transported from the image forming unit 1 to the first discharge port 64, after the trailing edge portion of the sheet passes thereby, the reverse branch member 66 blocks the sheet transport path 90, preventing the sheet transported in reverse from being returned to the image forming unit 1.

In the duplex print mode, when a relatively large number of sheets are output, the single-side print sheet and the duplex print sheet are alternately output, which is generally called interleaf control. More specifically, while the first discharge rollers 65 perform the switchback operation, forwarding the single-side print sheet to the sheet reverse unit 9, the second discharge rollers 63 discharge the duplex print sheet onto the discharge tray 41. Accordingly, there can be a sufficient time period for the first discharge rollers 65 to change rotational directions to the normal direction before receiving a subsequent single-side print sheet after rotating in the reverse direction. Thus, the image forming apparatus 100 can perform duplex printing with a sheet interval identical or similar to that in the single-side print mode. In other words, it is not necessary to accelerate a speed with which the sheet is transported (hereinafter "sheet transport speed") during the duplex printing mode from a speed with which the sheet is transported through the image forming unit 1 (hereinafter "speed during image formation" or "normal speed").

However, in the present embodiment, the sheet transport speed is accelerated after the sheet is transported for a predetermined or given time period downstream from the fixer 11 along the sheet transport path 90, and further the sheet is transported to the duplex transport path 91 with the accelerated speed similarly to the case in which the sheet handling unit 200 is mounted in the image forming apparatus 100 so as to simplify control.

Now, by contrast, descriptions are given below of the copying operation performed by the image forming apparatus 100 when the sheet handling unit 200 is mounted therein with reference to FIGS. 7 and 8.

Figure 7:
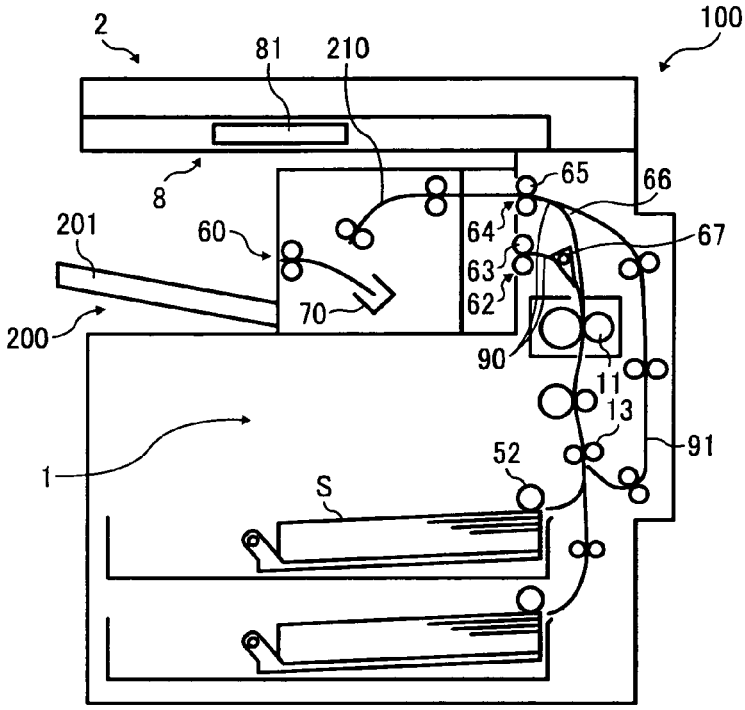
FIG. 7 is a cross-sectional view illustrating an interior of the image forming apparatus shown in FIG. 1, in which the sheet handling unit is mounted.
Figure 8:
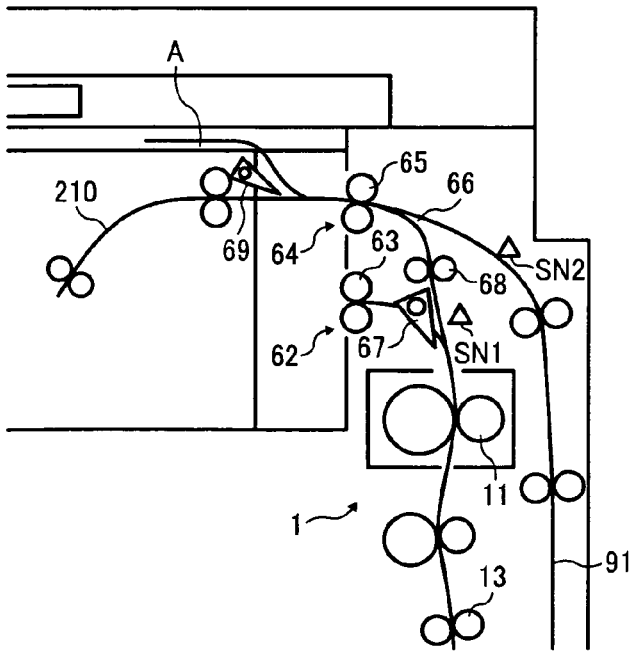
FIG. 8 is an enlarged view of the image forming apparatus shown in FIG. 7, illustrating a sheet transport control mechanism.

FIG. 7 illustrates the image forming apparatus 100 in which the sheet handling unit 200 is mounted, and FIG. 8 is an enlarged view illustrating main parts thereof.

Referring to FIG. 8, the image forming apparatus 100 further includes a first sheet detector SN1 located downstream from the fixer 11 in the sheet discharge direction, a second sheet detector SN2 located along the duplex transport path 91, a pair of transport rollers 68 located between the first sheet detector SN1 and the reverse branch member 66, and a switchback claw 69. The first sheet detector SN1 and the second sheet detector SN2 turn on when detecting the sheet and turn off after the sheet passes thereby.

Referring to FIG. 7, an image is formed on a first side of a sheet S and then fixed thereon by the fixer 11 through processes identical or similar to those performed when the sheet handling unit 200 is not mounted in the image forming apparatus 100.

While the sheet handling unit 200 is mounted in the image forming apparatus 100, the switching member 67 is constantly biased to block that branch of the sheet transport path 90 that leads to the second discharge rollers 63, and accordingly the sheet S is transported to the first discharge rollers 65 after image formation.

In the single-side print mode, the sheet S (single-side print sheet) transported to the first discharge rollers 65 is discharged onto the stack tray 201 after the sheet handling unit 200 performs, as required, the post-processing of the sheets including at least one of sorting, punching, aligning, and stapling.

By contrast, in the duplex print mode, the sheet S transported to the first discharge rollers 65 is forwarded to a switchback reverse path A shown in FIG. 8 in the sheet handling unit 200. When the trailing edge portion of the sheet S passes the reverse branch member 66, the first discharge rollers 65 stop rotating and then rotate in the reverse direction after a predetermined or given time period, forwarding the sheet S to the duplex transport path 91 in the sheet reverse unit 9. Then, the sheet S is further transported to the image forming unit 1.

Similarly to the case in which the sheet handling unit 200 is not mounted in the image forming apparatus 100, when a relatively large number of sheets are output, the interleaf control is performed in the duplex print mode.

However, while the first discharge rollers 65 perform the switchback operation so as to forward the single-side print sheet to the duplex transport path 91, the duplex print sheet is transported to the first discharge rollers 65. Accordingly, there is not a sufficient time period for the first discharge rollers 65 to change rotational directions to the normal direction before receiving a subsequent single-side print sheet after the switchback operation.

In view of the foregoing, in the present embodiment, the sheet transport speed is accelerated after the sheet is transported for a predetermined or given time period downstream from the fixer 11 along the sheet transport path 90, and further the sheet is transported to the duplex transport path 91 with the accelerated speed after the switchback operation.

Such sheet transport control is described below in further detail with reference to FIGS. 8, 9 and 10.

Figure 9:
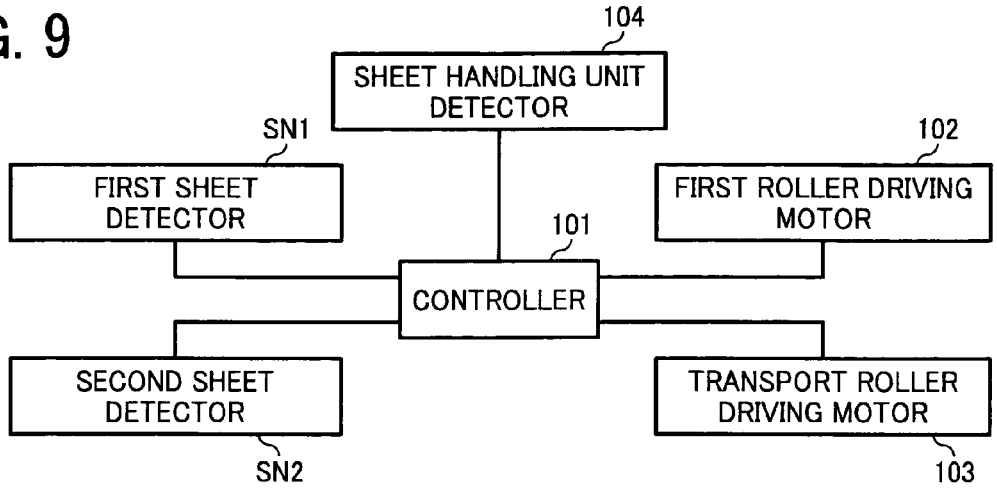
FIG. 9 is a block diagram illustrating main elements of the sheet transport control.

FIG. 9 is a block diagram illustrating main elements of a sheet transport control system.

As shown in FIG. 9, the image forming apparatus 100 includes a sheet handling unit detector 104, shown in FIG. 9, that detects that the sheet handling unit 200 is mounted in the image forming apparatus, although not shown in FIG. 8. For example, the sheet handling unit detector 104 can either electrically detect that the sheet handling unit 200 is connected to the image forming apparatus 100 or mechanically detect that the sheet handling unit 200 is mounted in the sheet discharge space 4.

Referring to FIG. 9, the image forming apparatus 100 further includes a controller 101 that is connected to a first roller driving motor 102 for driving the first discharge rollers 65, a transport roller driving motor 103 for driving the transport rollers 68, the sheet handling unit detector 104, the first sheet detector SN1, and the second sheet detector SN2. The controller 101 controls the sheet transport by controlling the first roller driving motor 102 and the transport roller driving roller 103 according to signals output from those detectors.

Figure 10:
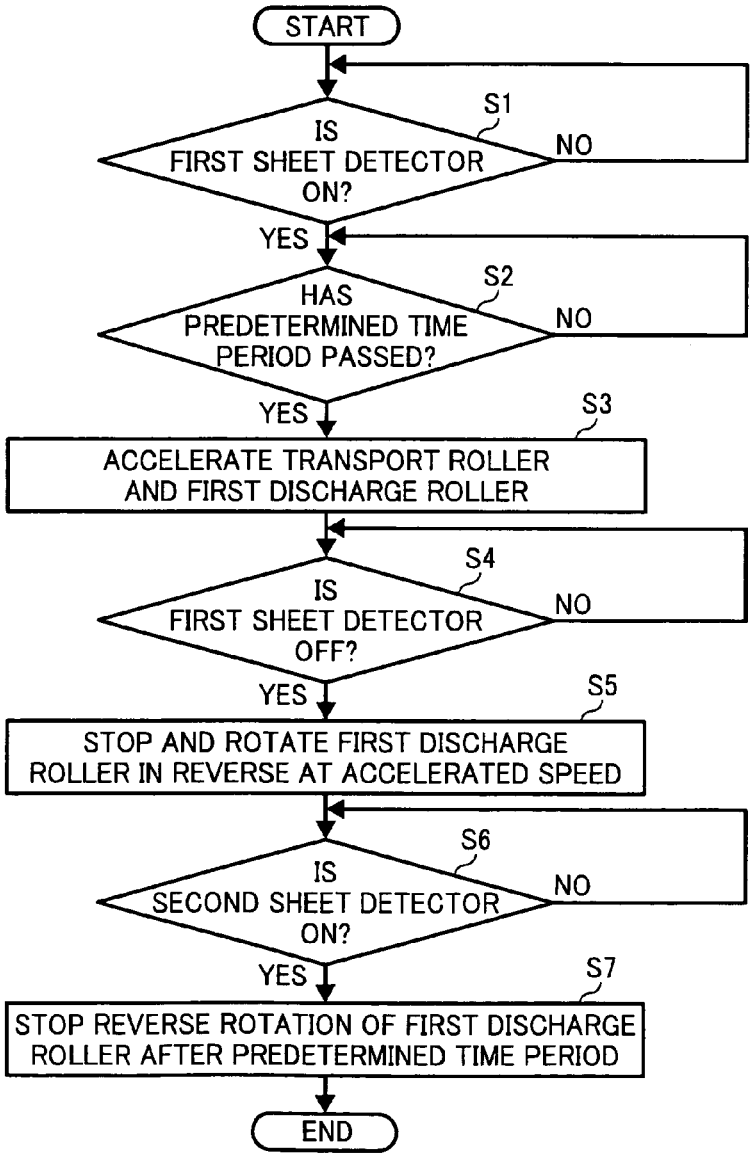
FIG. 10 is a flowchart of the sheet transport control.

FIG. 10 is a flowchart of the sheet transport control in the duplex print mode.

The registration rollers 13 stop the sheet transported through the sheet transport path 90 by sandwiching a leading edge portion thereof, and then rotate so as to forward the sheet to the image forming unit 1. The sheet is transported through the image forming unit 1 with the normal speed by transport rollers rotating at a velocity V1, that is, a proper speed for image formation, an image is formed on the first side thereof. After a time period required for the leading edge portion of the sheet to exit the image forming unit 1 including the fixer 11 has elapsed from when the registration rollers 13 start rotating, the first discharge rollers 65 and the transport rollers 68 start rotating with a constant velocity that is identical or similar to a velocity during image formation.

Subsequently, at S1 the controller 101 checks whether or not the first sheet detector SN1 detects the leading edge portion of the sheet, that is, the first sheet detector SN1 turns on.

When the first sheet detector SN1 detects the leading edge portion of the sheet, the trailing edge portion thereof is still present in the image forming unit 1. Accordingly, at S2 the controller 101 checks whether or not a predetermined or given time period required for the trailing edge portion of the sheet to exit the image forming unit 1 has elapsed after the first sheet detector SN1 detects the leading edge portion thereof. After this time period, the duration of which depends on sheet length in the sheet transport direction and the sheet transport speed (YES at S2), the sheet transport rollers 68 and the first discharge rollers 65 are rotated with a velocity V2 faster than the velocity during image formation V1 at S3.

At S4, the controller 101 checks whether or not the first sheet detector SN1 detects the trailing edge portion of the sheet, that is, the first sheet detector SN1 is off. After the trailing edge portion of the sheet passes by the first sheet detector SN1 (YES at S4), the controller 101 confirms that a predetermined or given time period required for the sheet to pass by the reverse branch member 66 has elapsed. In this state, the sheet is partly discharged from the first discharge port 64 to the switchback reverse path A. Then, at S5 the first discharge rollers 65 stop rotating and then start rotating with the velocity faster than the velocity during image formation, forwarding the sheet to the duplex transport path 91.

It is to be noted that, when the first discharge rollers 65 stop rotating, the rotational velocity of the transport rollers 68 reverts to normal.

At S6, the controller 101 checks whether or not the second sheet detector SN2 detects the leading edge portion of the sheet, that is, the second sheet detector SN2 is on. After a predetermined or given time period required for the trailing edge portion of the sheet to pass by the first discharge roller 65, the first discharge rollers 65 stop rotating in reverse at S7. The sheet is further transported along the duplex transport path 91 for duplex printing.

It is to be noted that, when a relatively large number of sheets are output in the duplex print mode, the registration rollers 13 can be set to start transporting a subsequent sheet at such a timing that the leading edge portion of the subsequent sheet is present between the transport rollers 68 and the first discharge rollers 65 when the first discharge rollers 65 stop rotating in reverse (S7).

By setting the timing of the registration rollers 13 as described above, there can be a sufficient time period for the first discharge rollers 65 to change rotational direction to the normal direction before receiving the subsequent sheet. Further, duplex printing can be performed efficiently at a relatively high speed.

The subsequent sheet transported by the registration rollers 13 at the timing described above is further transported by the transport rollers 68 at a constant speed identical or similar to the speed during image formation, and then the steps S2 through S7 are performed so as to control transport of the subsequent sheet.

The switching member 67 is described below in further detail with reference to FIGS. 8, 11, and 12.

Referring to FIG. 8, the switching member 67 is pivotally provided at a branch point where the discharge path 90 branches into two directions, one leading to the first discharge port 64 and the other leading to the second discharge port 62. Thus, the sheet can be selectively transported in one or the other of the two directions.

Figure 11:
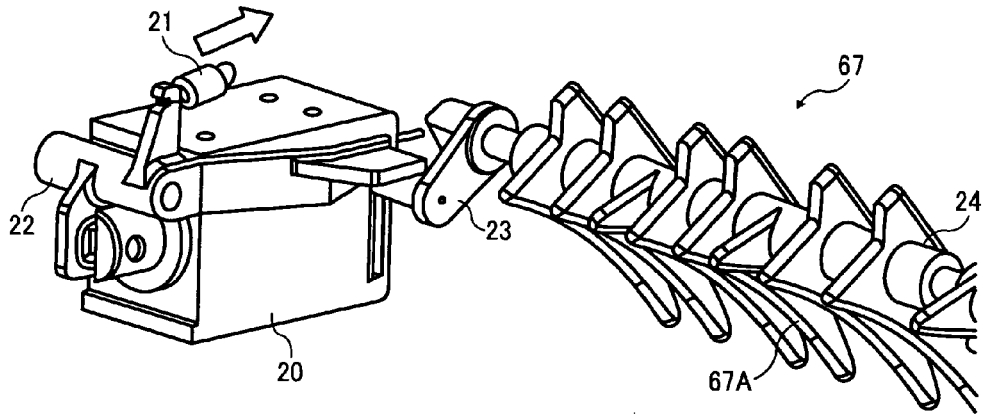
FIG. 11 illustrates an example of a configuration of a switching member.

As shown in FIG. 11, the switching member 67 includes multiple switching claws 67A each engaging a shaft 24 and fixed thereto, and a link 23 attached to a D-shaped end portion of the shaft 24. The link 23 is configured not to pivot on the shaft 24, and thus the link 23 does not rotate with respect to the switching claws 67A. The link 23 is rotated by a solenoid 20 via a solenoid link 22. The solenoid link 22 includes an upward projection provided with a recessed portion engaging a spring member 21.

The solenoid link 22 includes a horizontal plate portion that presses down a shaft portion of the link 23. Further, although not shown in FIG. 11, a link 25 shown in FIG. 12 is attached to a horizontal shaft portion of the solenoid link 22. The link 25 is rotatable coaxially with the solenoid link 22 and pushes up a portion of the solenoid link 22 so as to rotate the solenoid link 22 counterclockwise.

In the configuration described above, the switching member 67 can be pivoted by turning on and off the solenoid 20 so as to rotate the solenoid link 22 by a desired angle, controlling a rotational position of the link 23.

In FIG. 11, the solenoid 20 is off, and the spring member 21 pulls the solenoid link 22 in a direction indicated by an arrow, that is, the solenoid link 22 is suspended, receiving a clockwise force. Although the switching claws 67A are constantly biased clockwise in FIG. 11 by a spring, its bias force is weaker than the clockwise force of the spring 21 pulling the solenoid link 22, and thus the switching member 67 is at a position to guide the sheet to the second rollers 63 (second position), blocking the route leading to the first discharge port 64.

Figure 12:
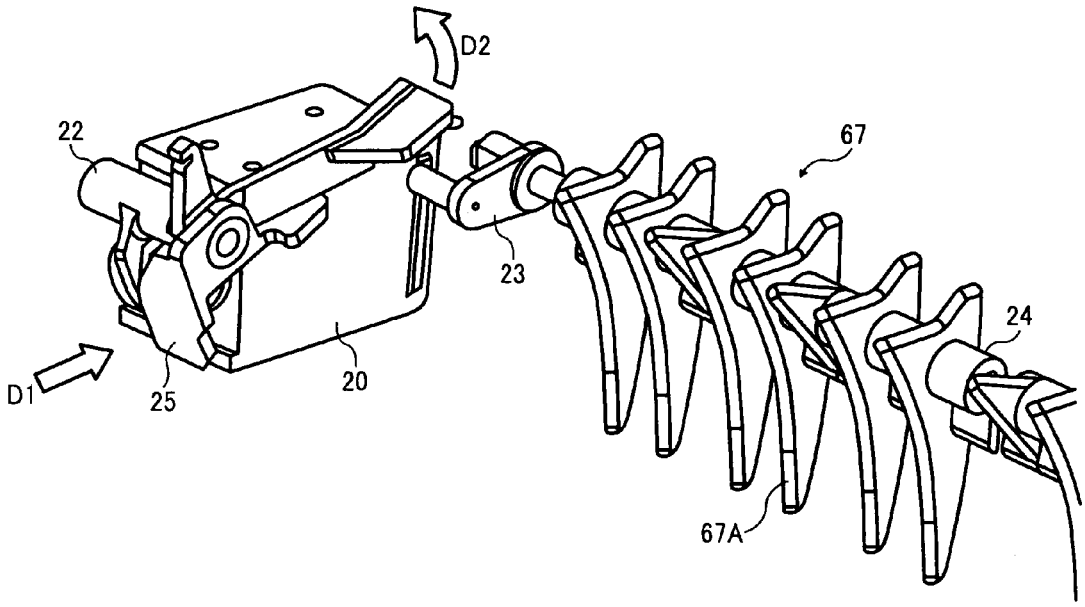
FIG. 12 illustrates a state of the switching member shown in FIG. 11 when the sheet handling unit is mounted in the image forming apparatus.
Figure 13:
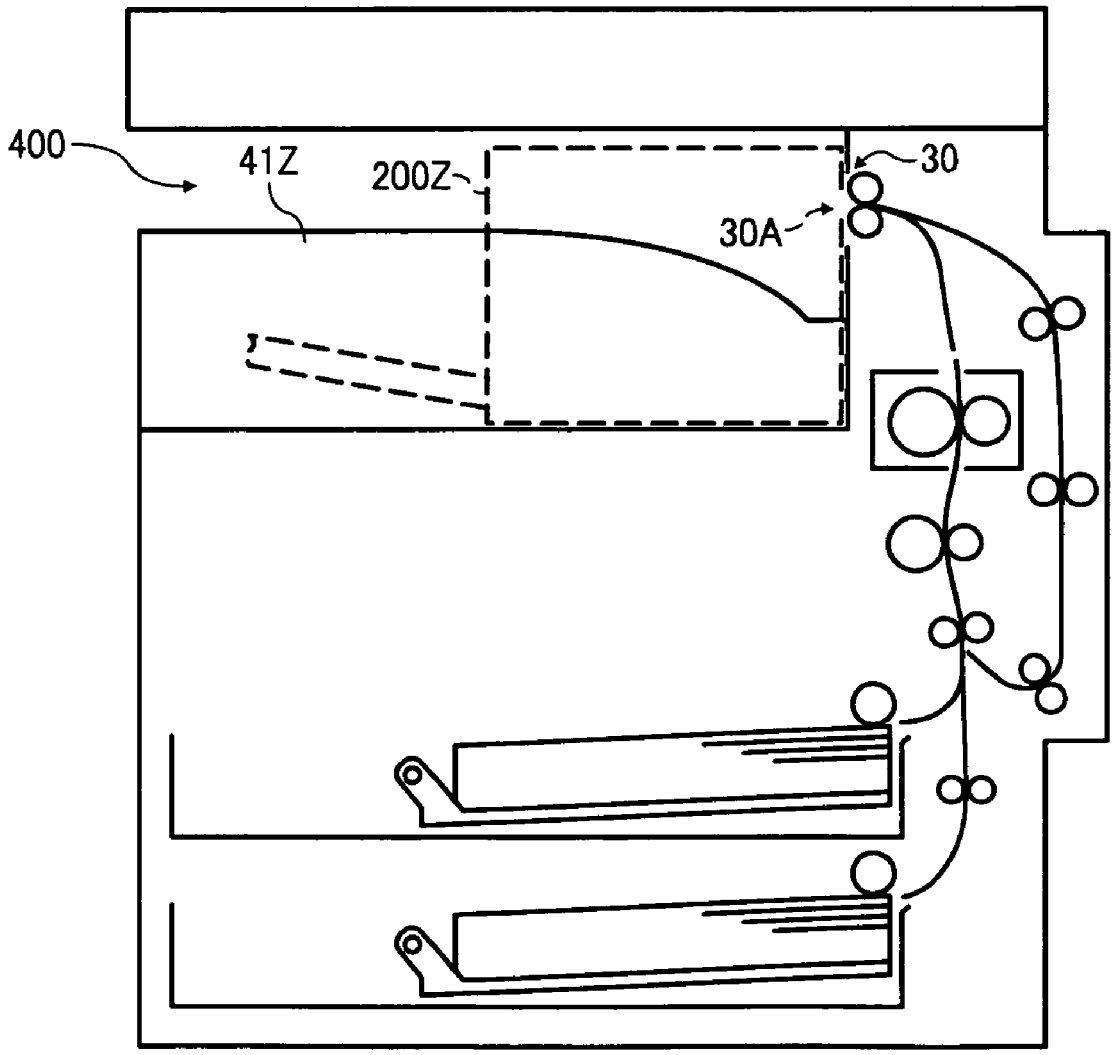
FIG. 13 RELATED ART
FIG. 13 an example of an housing-internal discharge type image forming apparatus, to which a sheet handling unit is mountable.

FIG. 12 illustrates a state of the switching member 67 when the sheet handling unit 200 is mounted in the image forming apparatus 100 as shown in FIG. 7.

Referring to FIG. 12, when the sheet handling unit 200 is mounted in the sheet discharge space 4, a first end portion of the link 25 is pushed in a direction indicated by arrow D1, and accordingly a second end portion thereof swings in a direction indicated by arrow D2, which causes the solenoid link 22 to rotate counterclockwise in FIG. 12. In this state, although not shown in FIG. 12, the spring member shown 21 shown in FIG. 11 expands in a direction opposite the direction indicated by the arrow, pulled by the upward projection of the solenoid link 22. When the solenoid link 22 thus rotates counterclockwise, a rock between the solenoid link 22 and the link 23 is unlocked, causing the switching member 67 to rotate clockwise and stops at a position shown in FIG. 12 (hereinafter "first position"). In this state, the switching member 67 guides the sheet to the first discharge rollers 65.

While the sheet handling unit 200 is mounted in the sheet discharge space 4, the switching member 67 is constantly biased to the first position without turning on the solenoid 20, which saves energy required to drive a device to rotate the switching member 67 as well as reduces risk of failure caused by that device.

It is to be noted that, in the embodiment described above, although the first discharge port 64 is used as the switchback reverse path through which transport direction of the sheet is reversed when the sheet handling unit 200 is not mounted in the image forming apparatus 100, alternatively, the first discharge port 64 can serve as the sheet discharge port only, and the sheet discharged from the first discharge port 64 can be stacked on the ancillary tray 42. Alternatively, the sheet discharged from the first discharge port 64 can be stacked on the discharge tray 41. In this case, the difference in height between the first discharge port 64 and the discharge tray 41 can be sufficient to stack the sheets neatly thereon.

Further, in the embodiment described above, although transport direction of the sheet is changed using the switchback reverse path A in the sheet handling unit 200 in the switchback operation, alternatively, the transport path 210 can be used as the switchback reverse path.

In the embodiment described above, two discharge ports are vertically provided on the surface, disposed facing the sheet discharge space, of the image forming apparatus, and the sheet handling unit is detachably attached to the first discharge port, blocking the second discharge port. Thus, the sheet discharge space can be relatively small in height, improving accessibility of the user to the image reading unit located above the sheet discharge space.

Further, the sheet reverse unit is provided on a side of the image forming apparatus, and the first discharge port is used as the switchback reverse path through which the transport direction of the single-side print sheet is changed to the duplex transport path in the sheet reverse unit. Thus, the switchback reverse path can be within the footprint of the image forming apparatus.

Moreover, when the sheet handling unit is not mounted in the image forming apparatus, the first discharge port is used as the switchback reverse path, and the second discharge port is used as the discharge port from which the sheet is discharged to the sheet discharge space. By contrast, when the sheet handling unit is mounted therein, the first discharge port can serve as both the switchback reverse path as well as the discharge port through which the sheet is discharged from the imager forming apparatus. Thus, the sheet discharge space can be efficiently used regardless of the presence of the sheet handling unit.

Further, the discharge tray whose upstream portion is located at a position lower than that of the second discharge port and height gradually increases downstream in the sheet discharge direction is detachably mounted in the sheet discharge space when the sheet handling unit is not mounted therein. Thus, the sheets can be neatly stacked on the discharge tray while providing a sufficient height for the user to pick up the sheet from the sheet discharge space, that is, usability of the image forming apparatus can be enhanced.

Moreover, when the sheet handling unit is mounted in the image forming apparatus, the sheet transport speed is accelerated before and after the switchback operation from the speed during image formation. Thus, intervals between sheets can be increased during the switchback operation without increasing that in the image forming unit, enhancing productivity of duplex printing.

By contrast, when sheet handling unit is not mounted in the image forming apparatus, the sheet transport speed can be identical or similar to the speed during image formation because there can be a sufficient time period for the first discharge rollers to change the rotational directions to the normal direction from the reverse direction before receiving a subsequent single-side print sheet.

Alternatively, the sheet transport speed can be accelerated before and after the switchback operation from the speed during image formation regardless of the presence of the sheet handling unit. In this case, the sheet transport control can be identical regardless of the presence of the sheet handling unit. Accordingly, the system can have fewer branches, which reduces the risk of failure caused by insufficient verification of system combination.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image reading unit configured to read image information of an original document;

an image forming unit configured to form an image on a sheet according to the image information;

a sheet discharge space located between the image reading unit and the image forming unit, into which the sheet is discharged after passing through the image forming unit;

a first sheet discharge port through which the sheet is discharged into the sheet discharge space;

a second sheet discharge port located beneath the first sheet discharge port, through which the sheet is discharged into the sheet discharge space; and a sheet handling unit detachably mounted in the sheet discharge space, configured to connect to the first sheet discharge port and block the second sheet discharge port when mounted in the sheet discharge space, wherein the sheet handling unit includes a stapler unit connected to the first sheet discharge port, such that when stapling is selected, more than one sheet are sequentially forwarded to the stapler unit to be stapled and then discharged from a discharge port of the sheet handling unit onto a stack tray, and when stapling is not selected, the sheet is transported along a path onto the stack tray without being forwarded to the stapler unit.

2. The image forming apparatus according to claim 1, further comprising a sheet reverse unit attachable to the image forming apparatus, configured to reverse the sheet and include a duplex transport path, wherein the first sheet discharge port serves as a switchback reverse path through which the sheet whose first side carries an image is forwarded to the duplex transport path.

3. The image forming apparatus according to claim 1, wherein, when the sheet handling unit is not mounted in the sheet discharge space, the first sheet discharge port serves as a switchback reverse path through which the sheet whose first side carries an image is forwarded to the duplex transport path, and the second sheet discharge port serves as a sheet discharge port through which the sheet is discharged from the image forming apparatus after passing through the image forming unit, and, when the sheet handling unit is mounted in the sheet discharge space, the first sheet discharge port serves as both the switchback reverse path as well as the sheet discharge port.

4. The image forming apparatus according to claim 1, further comprising a pivotable switching member configured to selectively guide the sheet to either the first discharge port or the second discharge port, provided on a sheet transport path that branches into a first route leading to the first discharge port and a second route leading to the second discharge port, wherein, when the sheet handling unit is mounted in the sheet discharge space, the switching member is constantly biased to a first position to guide the sheet to the first discharge port.

5. The image forming apparatus according to claim 1, wherein the sheet is transported at a velocity V2 faster than a velocity V1 with which the sheet is transported during image formation before and after a switchback operation when the sheet handling unit is mounted in the sheet discharge space.

6. The image forming apparatus according to claim 1, wherein the sheet is transported at a velocity V2 faster than a velocity V1 with which the sheet is transported during image formation before and after a switchback operation regardless of the presence of the sheet handling unit.

7. The image forming apparatus according to claim 1, wherein the sheet handling unit further includes a punch unit, the punch unit is closer to the first and second sheet discharge ports than the stapler unit.

8. An image forming apparatus, comprising:

an image reading unit configured to read image information of an original document;

an image forming unit configured to form an image on a sheet according to the image information;

a sheet discharge space located between the image reading unit and the image forming unit, into which the sheet is discharged after passing through the image forming unit;

a first sheet discharge port through which the sheet is discharged into the sheet discharge space;

a second sheet discharge port located adjacent to the first sheet discharge port, through which the sheet is discharged into the sheet discharge space; and a sheet handling unit detachably mounted in the sheet discharge space, configured to connect to the first sheet discharge port and block the second sheet discharge port when mounted in the sheet discharge space, wherein the sheet handling unit includes a stapler unit connected to the first sheet discharge port, such that when stapling is selected, more than one sheet are sequentially forwarded to the stapler unit to be stapled and then discharged from a discharge port of the sheet handling unit onto a stack tray, and when stapling is not selected, the sheet is transported along a path onto the stack tray without being forwarded to the stapler unit, and wherein, when the sheet handling unit is not mounted in the sheet discharge space, the first sheet discharge port serves as a switchback reverse path through which the sheet whose first side carries an image is forwarded to the duplex transport path, and the second sheet discharge port serves as a sheet discharge port through which the sheet is discharged from the image forming apparatus after passing through the image forming unit, and, when the sheet handling unit is mounted in the sheet discharge space, the first sheet discharge port serves as both the switchback reverse path as well as the sheet discharge port.

* * * * *